US008285194B2

(12) United States Patent
Hattori

(10) Patent No.: US 8,285,194 B2
(45) Date of Patent: Oct. 9, 2012

(54) BOOKBINDING APPARATUS AND IMAGE FORMING SYSTEM

(75) Inventor: Masato Hattori, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1157 days.

(21) Appl. No.: 12/135,561

(22) Filed: Jun. 9, 2008

(65) Prior Publication Data

US 2009/0129841 A1 May 21, 2009

(30) Foreign Application Priority Data

Nov. 16, 2007 (JP) ..... 2007-297788

(51) Int. Cl.
*G03G 21/00* (2006.01)
*B05C 9/14* (2006.01)
*B42C 9/00* (2006.01)

(52) U.S. Cl. ..... 399/408; 399/407; 412/8; 412/33; 412/37

(58) Field of Classification Search ..... 399/407, 399/408; 412/8, 33, 37
See application file for complete search history.

(56) References Cited

U.S. PATENT DOCUMENTS

| | | | | |
|---|---|---|---|---|
| 4,964,367 | A * | 10/1990 | Belter | 118/667 |
| 6,508,881 | B1 | 1/2003 | Muller et al. | |
| 6,964,707 | B2 * | 11/2005 | Taniguchi et al. | 118/244 |
| 2006/0127119 | A1 | 6/2006 | Sato | |
| 2007/0193511 | A1 * | 8/2007 | Sasamoto et al. | 118/666 |
| 2008/0056735 | A1 * | 3/2008 | Sorita et al. | 399/1 |
| 2008/0304934 | A1 * | 12/2008 | Kaneko | 412/11 |

FOREIGN PATENT DOCUMENTS

| | | | |
|---|---|---|---|
| DE | 3342231 | A1 * | 7/1984 |
| EP | 1 407 829 | A1 | 4/2004 |
| JP | 2001-121055 | | 5/2001 |
| JP | 2004209742 | A * | 7/2004 |
| JP | 2004-276457 | | 10/2004 |
| JP | 2005238526 | A * | 9/2005 |
| JP | 2006-62350 | | 3/2006 |
| JP | 2007-57580 | | 3/2007 |
| JP | 2007-62202 | | 3/2007 |
| JP | 2007-216152 | | 8/2007 |
| WO | WO 02/48271 | A1 | 6/2002 |

OTHER PUBLICATIONS

Machine Translation of JP 2005238526 A, JPO, Sep. 20, 2011.*
Official Translation of DE 3342231 A1, by FLS, Inc., Feb. 2012.*
European Search Report dated Mar. 27, 2009.
European Office Action dated Mar. 14, 2011, which issued in European Patent Application No. 08251955.4 (4 pages).
Japanese Office Action dated Jul. 17, 2009.

* cited by examiner

*Primary Examiner* — Judy Nguyen
*Assistant Examiner* — Nguyen Q Ha
(74) *Attorney, Agent, or Firm* — Finnegan, Henderson, Farabow, Garrett & Dunner, L.L.P.

(57) ABSTRACT

A bookbinding apparatus comprising: an adhesive container to store melted adhesive; a heater which heats the adhesive to melt; a stirring member to stir the adhesive in the adhesive container; and a control section which controls the operation of the heater and the stirring member so that after the heater has been turned off with the termination of a coating process, the stirring member continues stirring operation and stops thereafter.

9 Claims, 6 Drawing Sheets

BOOKBINDING APPARATUS AND IMAGE FORMING SYSTEM

CROSS-REFERENCE TO RELATED APPLICATION

The present application is based on Japanese Patent Application No. 2007-297788 filed with Japan Patent Office on Nov. 16, 2007, entire content of which is hereby incorporated by reference.

BACKGROUND

1. Field of the Invention

The present invention relates to a bookbinding apparatus and image forming system for binding a sheet bundle after coating the back of the sheet bundle with adhesive.

2. Description of Related Art

There has been a spread of on-demand printing system wherein an image is formed on paper, and a plurality of sheets of the paper with image formed thereon are made in a bundle, which is then bound and formed in a booklet. Such a printing system is often produced by a bookbinding apparatus wherein a hot melt blue is applied onto the back of the sheet bundle made by stacking the sheets of paper having an image formed thereon, and the sheet bundle is then bound to produce a booklet.

The adhesive applied to the back of a sheet bundle is a solid pellet at the normal temperature, and is dissolved and liquefied by being heated in the adhesive container of the coating apparatus. Then the adhesive is coated.

The Japanese Unexamined Patent Application Publication No. 2007-62202, Japanese Unexamined Patent Application Publication No. 2007-57580 and Japanese Unexamined Patent Application Publication No. 2006-62350 propose the method of turning off the adhesive heating heater when the coating apparatus is not used for coating, and the method of maintaining the adhesive temperature below the temperature required for coating, from the viewpoint of power saving to minimize the power consumption resulting from adhesive heating, and from the viewpoint of protecting against odor produced by adhesive heating.

The bookbinding apparatus in the print on-demand system is not working when the whole system is in the standby mode. The apparatus is working as a whole system, but is regarded as not working during execution of a job other than bookbinding.

Thus, from the viewpoint of power saving and protection against odor, it is more effective to turn off the heater for heating the adhesive, or to keep the adhesive temperature lower than the coating temperature, when the bookbinding apparatus is not working.

Such an adhesive temperature control is also effective to protect against deterioration of the adhesive.

To be more specific, if the adhesive is placed under the conditions of high temperature for a long time, discoloration or degradation of adhesive force will proceed. When the bookbinding apparatus is not working, adhesive temperature must be reduced.

As described above, when the bookbinding apparatus is not working, control is provided in such a way that the adhesive heating heater is turned off, or the adhesive temperature is set at the low temperature which is higher than the normal temperature but is lower than the coating temperature. The heater is turned on by the bookbinding startup signal to raise the adhesive temperature, whereby coating is started.

However, in the control during the shut-off period of the bookbinding apparatus and startup control, the following problems have been found to occur:

As described with reference to the Japanese Unexamined Patent Application Publication No. 2007-62202, the adhesive temperature in the adhesive container is managed by the control using the temperature sensor. The operation of the bookbinding apparatus starts in response to the signal of the temperature sensor, which indicates that the temperature has reached the level that allows the adhesive to be coated.

The temperature sensor for detecting the adhesive temperature in the adhesive container is arranged at the center of the adhesive container so as to detect the temperature close to that of the adhesive drawn up by the coating roller located at the center of the adhesive container.

Thus, the temperature sensor detects the adhesive temperature at the center of the adhesive container. However, since the adhesive has a high degree of viscosity, there is little convection of adhesive in the adhesive container. If the molten adhesive is left at rest, a difference occurs between the adhesive temperature at the center and that on the periphery.

FIG. 4 shows such a temperature difference. The adhesive temperature at the center CA is higher than that on the periphery PA.

The temperature sensor 57 placed at the center CA detects the high temperature at the center CA. In the presence of such a temperature difference, the coating roller 51 rotates to start coating operation.

As described above, such control as temperature management is performed according to the temperature detected by the temperature sensor 57. When the high temperature at the center CA is detected and coating of the adhesive has started, the sufficiently molten adhesive is coated in the form of a lump. This may result in uneven coating in some cases.

SUMMARY

According to one aspect of the present invention, there is provided a bookbinding apparatus comprising: an adhesive container to store melted adhesive; a heater which heats the adhesive to melt; a stirring member to stir the adhesive in the adhesive container; and a control section which controls the operation of the heater and the stirring member so that after the heater has been turned off with the termination of a coating process, the stirring member continues stirring operation and stops thereafter.

DETAILED DESCRIPTION OF THE PREFERRED EMBODIMENTS

The following describes the illustrated embodiments of the present invention with reference to drawings, without the present invention being restricted thereto.

Figure 1:
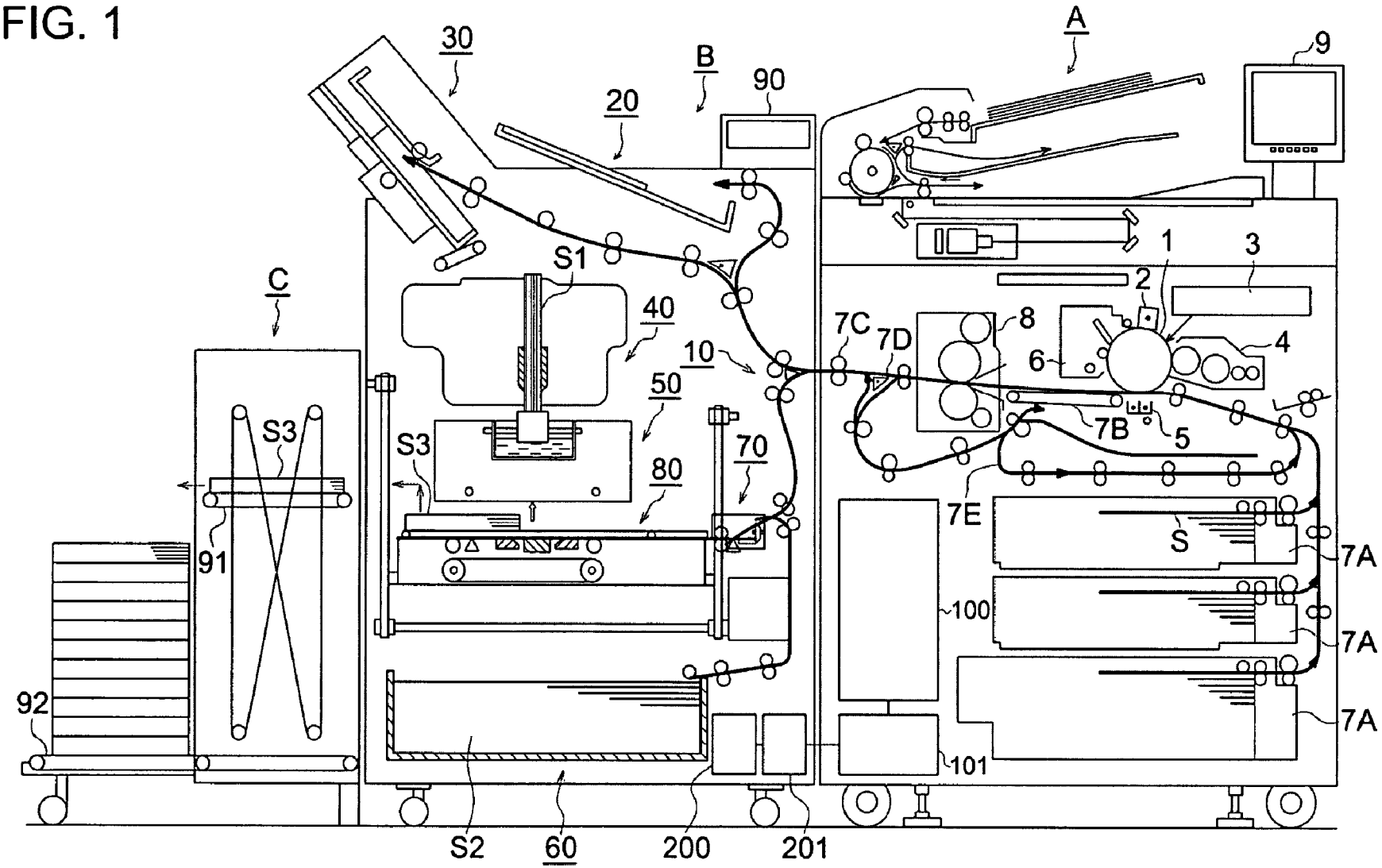
FIG. 1 is an overall view of the image forming system as an embodiment of the present invention.

FIG. 1 is an overall view of the image forming system as an embodiment of the present invention.

The illustrated image forming system includes an image forming apparatus A, a bookbinding apparatus B and a booklet storage apparatus C for storing the bookbound booklet.

[Image Forming Apparatus A]

The image forming apparatus A includes an image forming device wherein charging device 2, image exposure device 3, development device 4, transfer/discharge device 5, and cleaning device 6 are arranged around the rotating image carrier 1.

After the surface of the image carrier 1 has been uniformly charged by the charging device 2, the image forming device performs exposure and scanning operation in response to the image data read from the document by the laser beam of the image exposure device 3 or the image data received from the outside, whereby a latent image is formed. This latent image is subjected to reversal development by the development device 4, and a toner image is formed on the surface of the image carrier 1.

The sheet S fed from the sheet storage device 7A is sent to the transfer position. At the transfer position, the toner image is transferred onto the sheet S by the transfer/discharge device 5. After that, the sheet S is discharged and is separated from the image carrier 1. It is then conveyed by the conveyance device 7B, and is heated and fixed by the fixing device 8 to be ejected by the ejection roller 7C.

When an image is formed on both surfaces of the sheet S, the sheet S heated and fixed by the fixing device 8 is branched off from the routine sheet ejection passage by the sheet conveyance path switching device 7D, and is switched back by the reverse conveyance device 7E. After having been reversed, the sheet S again passes through the transfer/discharge device 5. An image is formed on the rear of the sheet S by the transfer/discharge device 5. The sheet S with an image formed on the rear passes through the fixing device 8 and is ejected out of the apparatus by the ejection roller 7C. The sheet S ejected by the ejection roller 7C is fed into the bookbinding apparatus B.

The developer remaining on the surface is removed from the surface of the image carrier 1 after image processing by the cleaning device 6 so that the apparatus is ready for the next image forming operation.

The upper portion of the image forming apparatus A is provided with an operation/display device 9 including an input device and display device.

[Bookbinding Apparatus B]

The bookbinding apparatus B of the present invention includes a sheet conveyance section 10, ejection section 20, sheet bundle storage section 30, sheet bundle conveying section 40, coating section 50, cover sheet supply section 60, cover sheet cutting section 70, cover sheet support member 80, and operation display section 90.

The sheet S with an image formed thereon by the image forming apparatus A is conveyed by the sheet conveyance section 10, and a plurality of sheets S are stacked on the sheet bundle storage section 30. The stacked sheets S form a sheet bundle S1.

The sheet bundle S1 is fed to a predetermined position by a sheet bundle conveying section 40, and the spine of the sheet bundle S1 is coated with adhesive by the coating section 50.

The spine of the sheet bundle S1 coated with adhesive is bonded with the cover sheet S2 supported by the cover sheet support member 80. The sheet bundle S1 is folded along both edges of the spine of the sheet bundle S1 to form a booklet S3.

The following describes the details of the bookbinding processes:

The sheet S having been introduced to the sheet conveyance section 10 is fed to any one of the ejection section 20, sheet bundle storage section 30 and cover sheet support member 80 by a plurality of conveyance rollers and sheet conveyance path switching gate.

When there is no designation of the process of bookbinding, the sheet S ejected from the image forming apparatus A is ejected into the ejection tray of the ejection section 20 according to the setting of the sheet conveyance path switching gate.

Figure 2:
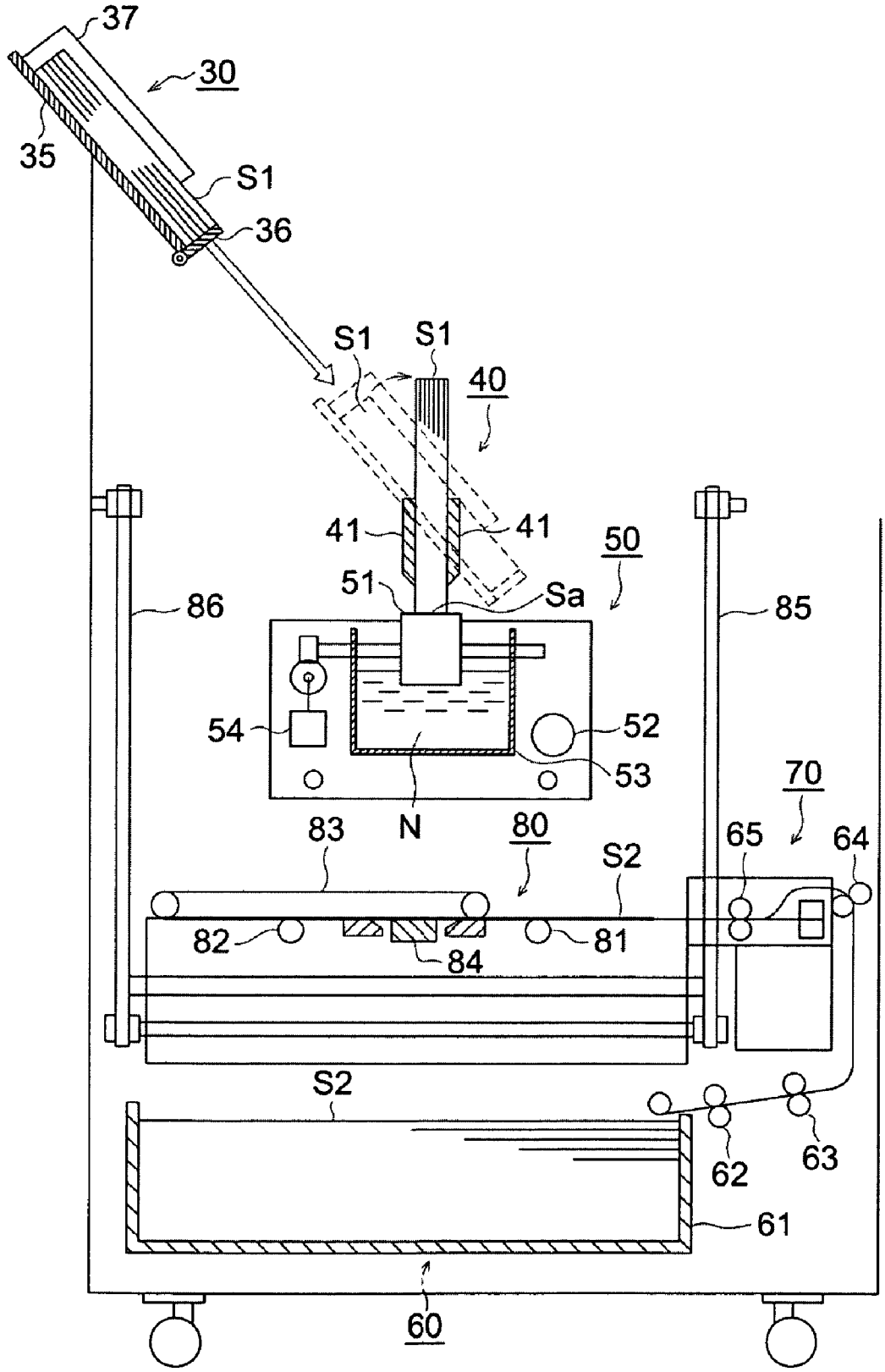
FIG. 2 is a conceptual diagram of the bookbinding apparatus describing the process of sheet bundle formation and thereafter.

FIG. 2 is a conceptual diagram of the bookbinding apparatus describing the process of sheet bundle formation and thereafter.

The sheet bundle storage section 30 includes a sheet placement table 35 placed in a slanting direction, movable sheet trailing end positioning member 36, and aligning member 37 for alignment across the width.

The sheet S ejected from the image forming apparatus A and fed by the sheet conveyance section 10 are sequentially placed on the sheet placement table 35, and a sheet bundle S1 made up of a predetermined number of sheets is formed.

After the process of alignment, the sheet bundle S1 placed on the sheet placement table 35 of the sheet bundle storage section 30 is held by the holding device 41. When the sheet bundle S1 is held by the holding device 41, the sheet trailing end positioning member 36 is driven by the drive section (not illustrated) and waits below the sheet placement table 35.

The holding device 41 holding the sheet bundle S1 moves obliquely toward the bottom as indicated by the broken line of the drawing, and is swiveled. The holding device 41 holds the sheet bundle S1 upright so that the spine Sa of the sheet bundle S1 to be coated adhesive is located below, and then stops at a predetermined position.

The cover sheet S2 stored in the cover sheet stacking device 61 of the cover sheet supply section 60 is separated and fed by the sheet feed device 62, and is sandwiched between the conveyance rollers 63, 64 and 65. The cover sheet S2 is then fed by the conveyance rollers 81 and 82 of the cover sheet support member 80 is stopped at a predetermined position.

When the cover sheet S2 has a length greater than length required when the sheet bundle S1 is subjected to the operation of folded binding, the cover sheet S2 is trimmed by the cover sheet cutting section 70 arranged on the right of the conveyance roller 65 so that the excess portion is removed in advance.

After adhesive has been coated on the spine Sa by the coating section 50, the coating section 50 moves to the furthest side of the sheet face in the drawing, and the cover sheet support member 80 is moved upward by the belts 85 and 86. The cover sheet S2 supported by the rollers 81 and 82 and support base 84 comes in contact with the spine Sa of the sheet bundle and is bonded to the sheet bundle S1 to form a booklet S3.

The cover sheet S2 of the booklet S3 having been formed is bent by a mechanism (not illustrated) to fold the sheet bundle S1.

Figure 3:
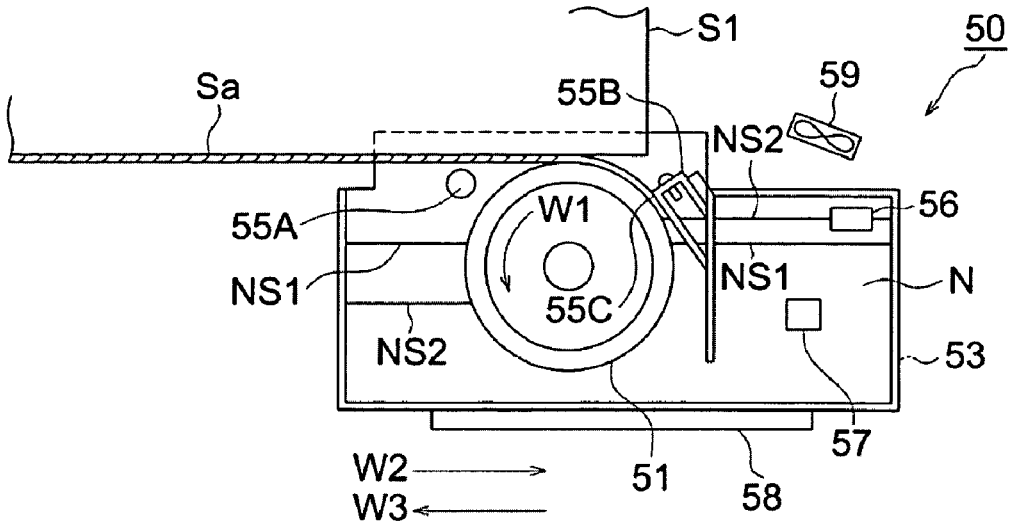
FIG. 3 is a conceptual diagram of a coating section.

The booklet S3 having been produced is ejected by the belt 83. FIG. 3 is a cross sectional view representing the coating section 50.

The coating section 50 includes a adhesive container 53 storing the adhesive N, a coating roller 51 as a stirring member to stir the adhesive N in the adhesive container 53, a motor 52, a roller motor 54 (the 52 and 54 shown in FIG. 2), regulating members 55A, 55B and 55C, a liquid level sensor 56, a temperature sensor 57, a heater 58 and a fan 59.

The coating section 50 is driven by the motor 52 to make a reciprocating motion in the directions W2 and W3 of FIG. 3. Glue is coated in both the outward and homeward movements.

The coating roller 51 is driven by the roller motor 54, and is rotated as shown by the arrow W1 so that the adhesive N is coated on the spine Sa of the sheet bundle.

The coating roller 51 coats the adhesive N and stirs the adhesive N in the adhesive container 53.

When the coating roller 51 is rotating, the adhesive N is made to circulate by the stirring operation, and the surface is displaced to the NS2 from the NS1 wherein the surface is in the state of repose.

The regulating member 55A is a round rod-shaped regulating member and regulates the coated film thickness when coating operation is performed in the outward movement indicated by arrow W2.

The regulating member 55B performs the operation of regulation according to the angle formed by bending the plate-formed member, and regulates the coated film thickness in the homeward movement indicated by arrow W3.

The regulating member 55C regulates the volume of adhesive on the coating roller 51.

The adhesive container 53 is supplied with solid pellet-like hot melt adhesive, and is melted and liquefied by the heat of the heater 58 installed on the bottom of the adhesive container 53.

The liquid level of the adhesive in the adhesive container 53 is managed by the liquid level sensor 56 made up of a temperature sensor, and a solid adhesive is supplied when the liquid level has been reduced so that a predetermined adhesive liquid level is maintained.

The temperature sensor 57 detects the temperature at the center of the adhesive N melted in the adhesive container 53.

The temperature of the adhesive N in the adhesive container 53 is managed according to the temperature detected by the temperature sensor 57 so that adequate coating temperature is ensured at the time of coating.

The fan 59 is an odor prevention device for recovering the odor generated by heating the adhesive, and accelerates the reduction in temperature of the adhesive N.

[Control of Coating Section]

In the first place, the following describes the temperature in the adhesive container.

If the adhesive N in the non-operating coating section 50 is heated and is left immovable for a long time in a liquefied state, the following problems will occur and should be avoided: (A) Much power will be consumed to keep the adhesive at a high temperature. This is to be avoided from the viewpoint of power saving. (B) Discoloration and reduction in adhesive strength will be accelerated. (C) Offensive smell will be generated.

Thus, after the lapse of a predetermined time period upon completion of coating operation, the heater is preferably turned off.

However, if the heater is turned off and the adhesive temperature is reduced, a long start-up time is required.

To solve this problem, it is effective to provide a low power mode that keeps the adhesive temperature higher than the normal temperature but lower than the coating temperature.

Shift can be made in a short time from the low power mode to the ready mode in which coating is enabled. Thus, reduction of the working efficiency due to turning off of the heater can be avoided to a substantial degree.

Further, a shut-off mode is provided to turn off the adhesive heating heater when the coating section 50 does not work for a long time.

In the shut-off mode, the entire bookbinding apparatus is in the ready mode. The shut-off mode is the mode to shut off the coating section 50. Only the coating section 50 is shut off and the shut-off mode is set up in the image formation mode in which bookbinding is not performed, for example, the mode in which only image formation is executed without the finishing process such as a bookbinding process being performed, or the finishing mode in which finishing other than bookbinding is performed.

However, when the apparatus is restarted from the low power mode or shutoff mode, it has been found out that the coating section 50 fails to perform normal operation in some cases.

Figure 4:
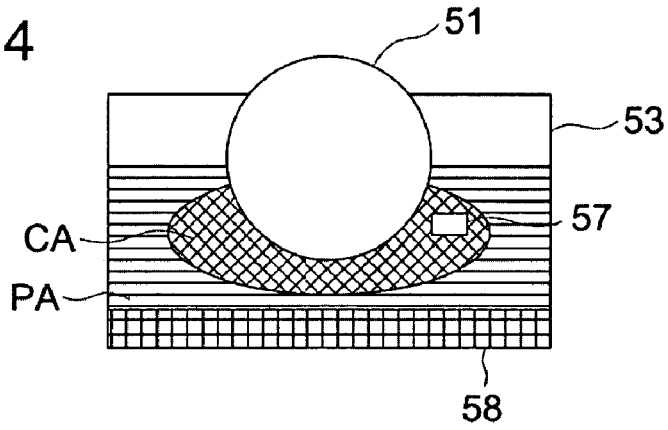
FIG. 4 is a diaphragm representing the temperature distribution in a adhesive container.

This has been revealed to have been caused by the temperature distribution in the adhesive container, as will be described later. FIG. 4 is a diaphragm representing the temperature distribution in a adhesive container 53 when the coating section 50 is shut off.

If the adhesive continues to stay immovable inside the adhesive container 53, temperature reduction is smaller at the center is small but is greater on the periphery. This results in temperature distribution in such a way that the temperature at the center CA in the vicinity of the coating roller 51 arranged at the temperature sensor 57 is high and the temperature is low on the periphery PA.

The temperature at the center CA is detected by the temperature sensor 57. If suitability of coating is determined based on the result of detection, correct determination cannot be obtained. This will be described with reference to FIGS. 5 and 6.

Figure 5:
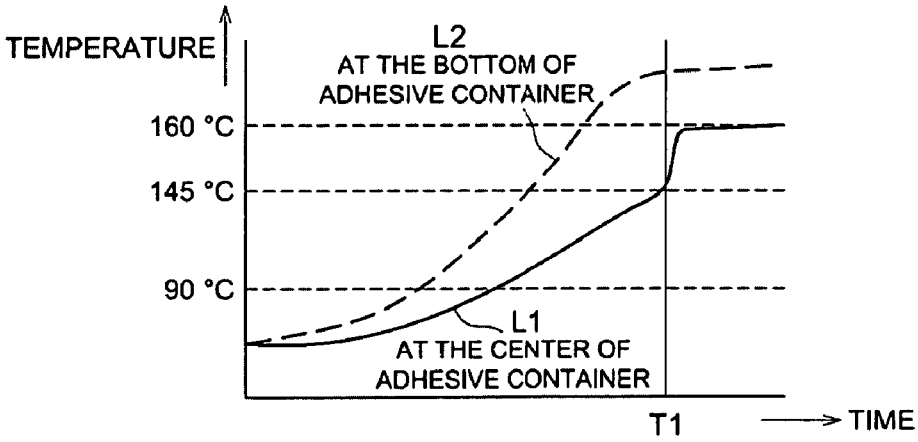
FIG. 5 is a chart representing a change in adhesive temperature.

In FIG. 5, the curve L1 shows the change in adhesive temperature at the center of the adhesive container 53 in warming up mode, whereas the curve L2 indicates the change in adhesive temperature at the bottom of the adhesive container 53 in warming-up mode.

Figure 6:
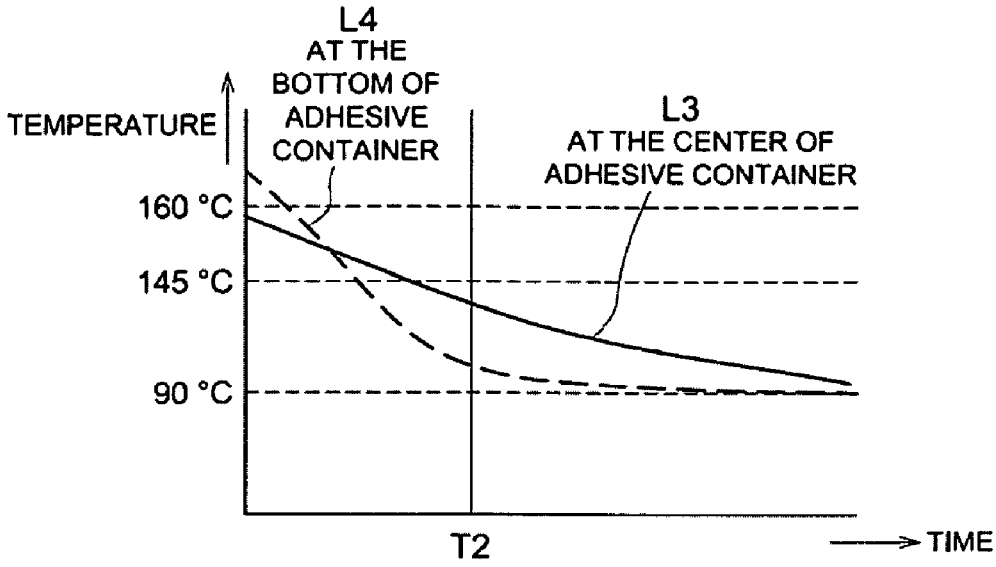
FIG. 6 is a chart representing a change in adhesive temperature.

In FIG. 6, the curve L3 shows the change in adhesive temperature at the center of the adhesive container 53 when the curve L3 is shut off, whereas the curve L4 shows the change in adhesive temperature at the bottom of the adhesive container 53 when the curve L4 is shut off.

160° C. corresponds to the adequate coating temperature (first temperature), 145° C. signifies the threshold value temperature (the second temperature) wherein coating has been determined to be possible, and 90° C. indicates the adhesive melting point.

As shown in FIG. 5, the heater 58 is turned on by the startup signal to start heating of the adhesive, and the adhesive temperature rises.

There is a quick rise of temperature at the bottom close to the heater 58 as illustrated by curve L2.

When having detected that the center CA in the adhesive container 53 has reached the level of 145° C., the temperature sensor 57 outputs the signal of permitting the operation of coating, and the coating roller 51 starts rotation.

The adhesive N is stirred by the rotation of the coating roller 51. Thus, as a result of mixing between the high-temperature adhesive on the bottom and the low-temperature adhesive on the top, the adhesive temperature at the center detected by the temperature sensor 57 exhibits a sudden rise in a short time from when the rotation of the coating roller 51 has started, and the adequate coating temperature of 160° C. is reached at time point T1.

Thus, coating is enabled at time point T1.

As described above, the warming up time is reduced by setting the coating temperature below the adequate coating temperature, whereby the warming up time is reduced.

In the shut-off period subsequent to coating shown in FIG. 6, the adhesive temperature (temperature shown by curve L3) detected by the temperature sensor 57 is higher than 145° C. up to the time point T2. However, the temperature of the adhesive container bottom is reduced below 145° C. at time point T2, as shown by curve L4.

While the detection temperature of the temperature sensor 57 is higher than 145° C., namely, up to time point T2 after the heater 58 has turned off, coating is evaluated as being enabled. When coating start command signal has been received during time, coating should start. However, as shown in FIG. 6, the adhesive temperature in the adhesive container 53 is lower than 145° C., and is not an adequate coating temperature.

Thus, when coating has started in response to the restart signal from the start at the shutoff status to the time point T2, irregular coating may occur.

The present invention takes the following measures to solve this problem:

During the period when the temperature sensor 57 may detect the temperature as appropriate to coating, the coating roller 51 is rotated and the adhesive N in the adhesive container 53 is stirred, thereby ensuring uniform temperature distribution in the adhesive container 53.

This arrangement prevents the temperature sensor 57 from generating an incorrect coating enable signal.

The coating roller 51 is stopped at the time point wherein the reading of the temperature sensor 57 has been reduced to the temperature wherein there is no possibility of an incorrect detection signal being issued.

The adhesive temperature in the adhesive container 53 is uniformly reduced by the rotation of the coating roller 51, and reduction of adhesive temperature in the shutoff period is accelerated, whereby degradation of adhesive can be avoided.

The fan 59 prevents odor from occurring by attracting the air in the vicinity of the adhesive container 53. It promotes reduction in adhesive temperature at the time of suspension, namely, in the shutoff mode or low power mode, and prevents the adhesive from being degraded.

The control of the coating section 50 will be described with reference to FIGS. 7 through 9.

Figure 7:
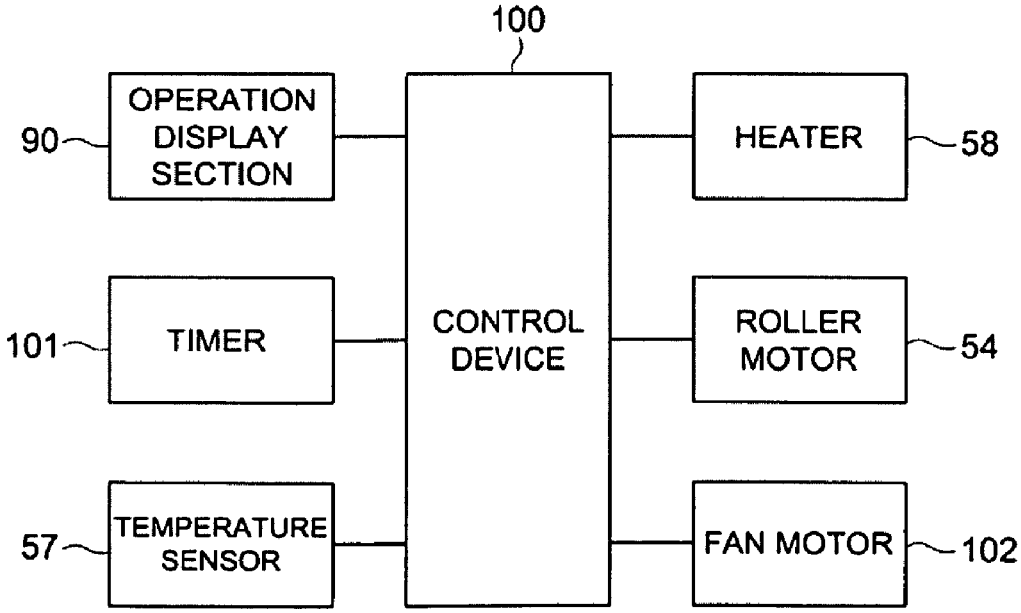
FIG. 7 is a block diagram showing the control system.
Figure 8:
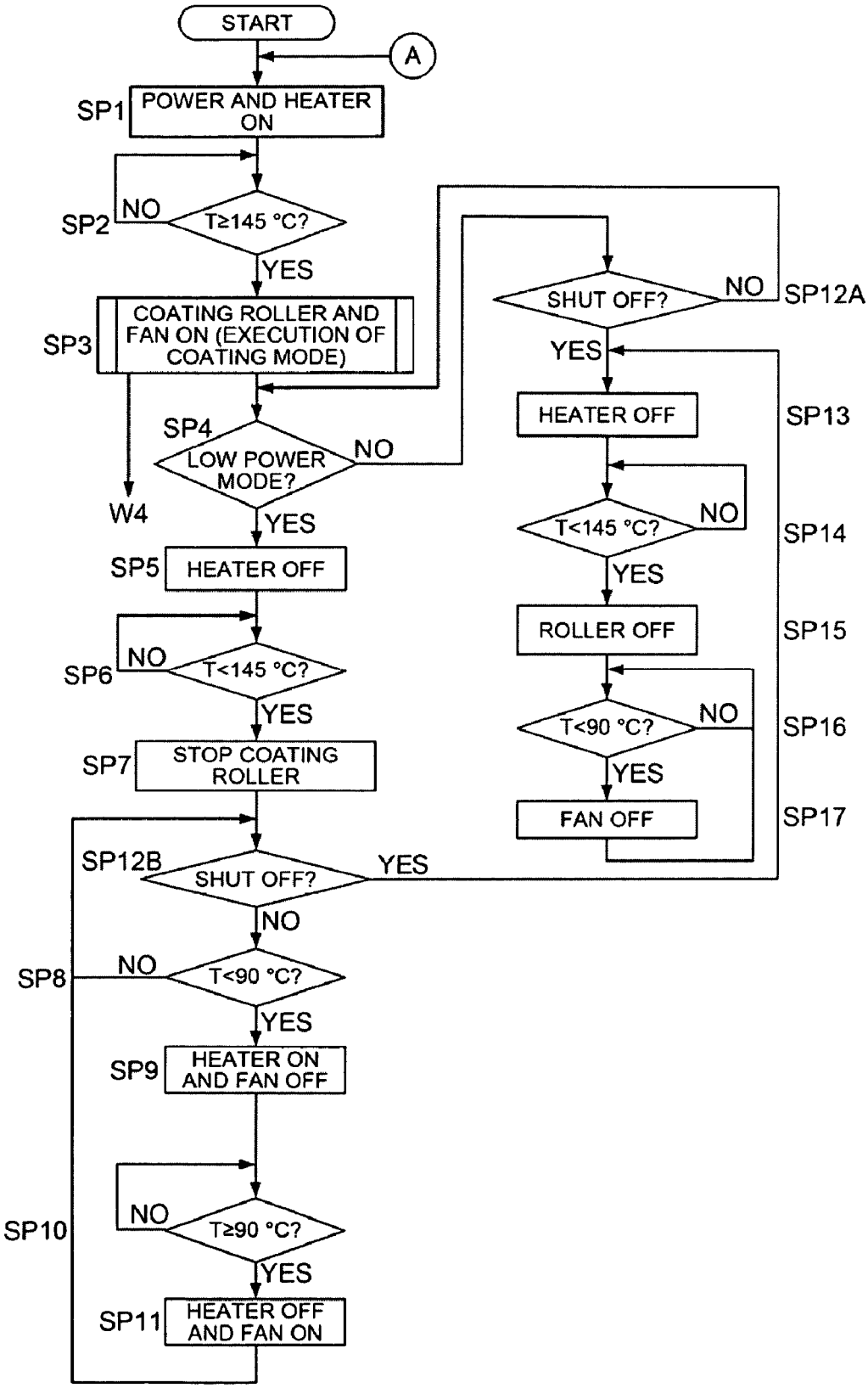
FIG. 8 is a flow chart representing the control of temperature.
Figure 9:
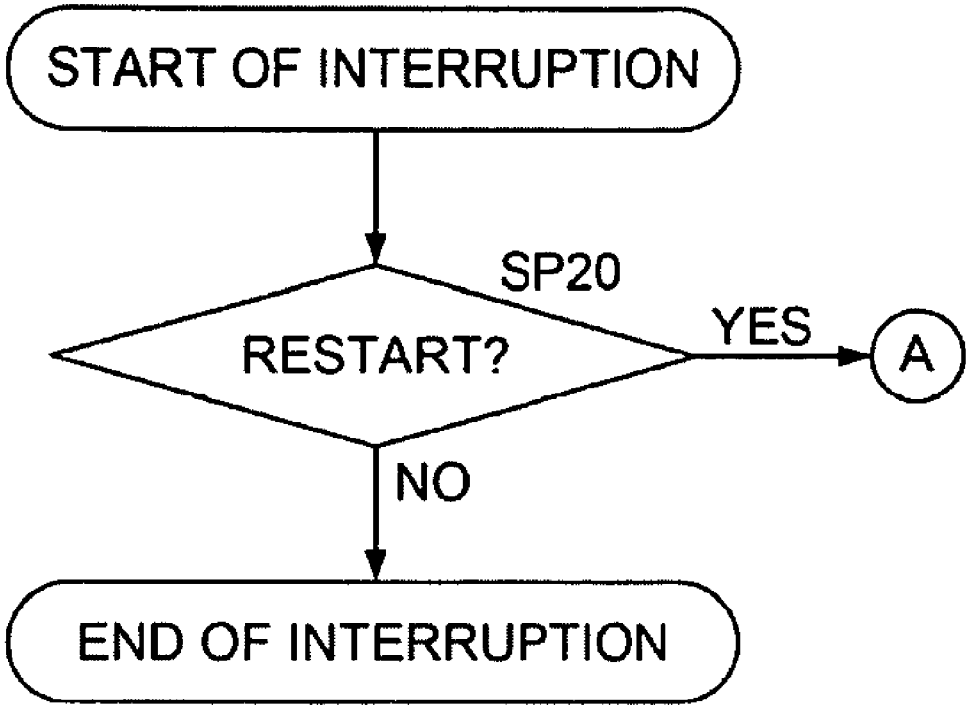
FIG. 9 is a flow chart representing the interrupt control.

FIG. 7 is a block diagram showing the control system, and FIGS. 8 and 9 are flow chart representing the control.

According to commands such as the coating start command in the operation display section 90, shutoff command and low power command, the signal from timer 101 and the detection signal of the temperature sensor 57, the control device 100 performs various forms of decision and computation controls the roller motor 54 that drives the heater 58 and coating roller 51, and the fan motor 102 that drives the fan 59.

The low power mode in the following description applies current to the heater 58, and maintains the adhesive temperature at a level higher than the normal temperature but lower than the temperature wherein coating is enabled. This mode reduces the startup time while ensuring power saving, prevention of adhesive from being degraded, and avoiding generation of odor.

In the low power mode, the adhesive temperature is kept at the fourth temperature lower than the coating temperature and higher than the normal temperature. In the example described below, the fourth temperature is set at 90° C. which is the melting point of adhesive N.

Further, in the shut-off mode, the bookbinding apparatus B as a whole is not turned off, but the coating section 50 is turned off.

The main power supply and heater 58 are turned on and heating of the adhesive N starts (Step SP1).

In Step SP2, a decision is made to see whether or not the temperature detected by the temperature sensor 57 is above 145° C.

When the temperature has exceeded 145° C., the system determines that coating is enabled (SP2: Yes). In Step SP3, the coating roller 51 starts rotation and the fan 59 turns on (SP3).

The fan 59 is turned off up to 145° C. wherein a decision is made to see if coating is enabled or not, and is turned on when the temperature above 145° C. has been detected.

The arrangement ensures that rise of adhesive temperature will not be delayed and odor will not occur at the time of high temperature.

When coating command signal has been received in Step SP3, the system enters the coating mode and coating operation starts.

To be more specific, the coating section 50 moves and the coating roller 51 rotates so that adhesive is coated on the spine Sa of the sheet bundle S1.

In the coating mode, adhesive temperature in the adhesive container 53 is kept at the coating temperature which is the first temperature.

In FIG. 5, the coating temperature as the first temperature is 160° C. Glue temperature is kept at 160° C. based on the temperature detected by the temperature sensor 57, and coating operation is performed.

In Step SP4 upon completion of the coating operation, a decision is made to see whether or not the low power signal is present.

Shift to the low power mode is conducted in a case when instructed via the operation display section 90 or in a case when the timer 101 detects the lapse of a predetermined low power time.

It should be noted that, in the latter case, the mode shifts to the low power mode after a lapse of a predetermined period of time from the stoppage of the coating section 50 after completion of coating the adhesive. The low power time corresponds to the predetermined period of time. The length of the low power time can be set on the operation display section 90.

In the low power mode (SP4: Yes), the heater 58 is turned off (SP5). However, the coating roller 51 continues to rotate after the mode is changed to the low power mode and the heater 58 is turned off.

In Step SP6, a decision is made to see whether or not the adhesive temperature is below 145° C. If it is lower (SP6: Yes), the coating roller 51 stops rotation (SP7).

The temperature used in the Step SP6 and Step SP14 (to be described later) is the second temperature used to determine if coating is enabled or not. It is 145° C. in the example of FIG. 5.

As described before, above the second temperature the coating roller 51 is rotated to ensure uniform temperature distribution in the adhesive container 53, whereby the adhesive temperature rises to the appropriate adhesive application temperature (the first temperature).

After suspension of the coating roller 51, a decision is made to see whether or not the shutoff signal is issued (SP12B). If the shutoff signal is not issued (SP12B: Yes), a decision is made to see whether or not the adhesive temperature is below 90° C. which is the melting point (SP8). If it is lower, the heater 58 is turned on and the fan 59 is turned off (SP9).

The fan 59 is turned off in the third temperature wherein there is no need of promoting reduction of adhesive temperature as a result of reduction of the adhesive temperature or preventing occurrence of odor.

In the illustrated example, the third temperature is set to 90° C. which is the melting point of the adhesive.

In Step SP10, a decision is made to see whether or not the adhesive temperature is above 90° C. If it is over 90° C., the heater 58 is turned off and the fan 59 is turned on.

A loop of Steps SP8 through SP11 is formed and the adhesive temperature is kept at 90° C.

The temperature kept at a low power is the fourth temperature. The temperature that minimizes the power consumption and prevents odor from occurring is selected as the fourth temperature.

In the illustrated example, the third temperature is the same as the fourth temperature. These temperatures are be set to different levels.

The above arrangement reduces the restart time from the lower power mode.

In Step SP12A, when the shutoff signal is present, the system enters the shut-off mode (SP12: Yes).

Similarly to the case of low power, the shutoff signal is issued when the operator has presses the Shutoff button of the operation display section 90 or the time set on the shutoff timer has expired. As described above, the shut-off mode is the mode of turning off the bookbinding apparatus. Similarly to the case of the low power mode, the time of entering the shut-off mode can be set by the operator using the operation display section 90.

It should be noted, however, that the time of entering the shut-off mode—the time of entering the shut-off mode upon completion of coating—is set at a level longer than the time of entering the low power mode.

Accordingly, in addition to direct shift to the shut-off mode immediately after completion of coating, there is a case of shift from the low power mode to the shut-off mode. The Step SP12A indicates the case of direct shift to the shutoff mode. The Step SP12B represents the case of shift from the low power mode to the shut-off mode.

When the system has entered the shut-off mode, the heater 58 is turned off (SP13), and it is determined whether the adhesive temperature is below 145° C. (SP14) or not.

If the adhesive temperature is below 145° C., the coating roller stops in Step SP15.

To put it another way, the coating roller 51 continues rotation up to 145° C. in the shut-off mode, similarly to the case of low power mode.

Then a decision is made to see whether or not the adhesive temperature is below 90° C. (SP16). If it is lower, the fan 59 is turned off.

The shutoff mode in which both the roller and fan are off remains unchanged in the loop of Steps SP16 and 17.

Subsequent to Step SP3, the coating operation is performed, and the coating operation terminates. The system is ready to receive the low power or shutoff signal of Steps SP4 and 12 when the operation of the coating device is stopped. After the system has entered the low power or shutoff mode, the interrupt control is provided wherein the restart command is accepted at a predetermined time interval.

To put it another way, upon receipt of the restart signal of FIG. 9 (SP20: Yes), the system shifts to SP1 of FIG. 8, and the power and heater are turned on.

Thus, a coating command signal is received during the time period indicated by the arrow W4 of FIG. 8—from the time of entering the low power mode and shut-off mode to a desired time—, and coating operation is started.

The present embodiment provides a bookbinding apparatus that effectively solves the problem of irregular coating that may occur at the time of starting coating, whereby a sheet bundle is subjected to the process of binding at a predetermined binding strength to produce a high-quality booklet on a stable basis. An image forming system provided with this bookbinding apparatus is also provided by the present invention.

In the embodiment, rotation of the coating roller for coating adhesive to the sheet bundle is controlled, without the present invention being restricted thereto. The present invention also includes the case of controlling the operation of a stirring member for stirring adhesive in the adhesive container if equipped with such a stirring member, in addition to the coating roller.

What is claimed is:

1. A bookbinding apparatus for coating adhesive on a sheet bundle comprising:

an adhesive container that accommodates melted adhesive;

a heater that heats the adhesive to melt;

a temperature sensor configured to detect a temperature of the adhesive in the adhesive container;

a stirring member that stirs the adhesive in the adhesive container; and a control section configured to perform the following operations:

determine whether a coating of the adhesive is possible or not with reference to a threshold value temperature corresponding to a second temperature lower than a first temperature adequate for coating, based on the temperature detected by the temperature sensor;

set a coating mode in which a temperature of the adhesive in the adhesive container is kept at the first temperature for the coating operation based on the temperature detected by the temperature sensor;

set a shut-off mode in which the heater is turned off irrespective of the temperature detected by the temperature sensor;

turn off the heater with a completion of the coating operation;

continue a stirring operation by the stirring member for a period of time after the heater has been turned off in the shut-off mode; and stop the stirring operation by the stirring member thereafter.

2. The bookbinding apparatus of claim 1, further comprising a fan that removes air above the adhesive in the adhesive container, wherein the control section is configured to control the fan based on the temperature detected by the temperature sensor.

3. The bookbinding apparatus of claim 2, wherein the control section is configured to control the fan to stop when the temperature sensor detects, after the heater has been turned off, a temperature lower than a third temperature.

4. The bookbinding apparatus of claim 1, wherein the control section is configured to control the stirring member to stir, after the heater has been turned off, when the temperature sensor detects a temperature equal to the second temperature or more, and is configured to control the stirring member to stop stirring when the temperature sensor detects a temperature lower than the second temperature.

5. The bookbinding apparatus of claim 1, wherein the control section is configured to a low power mode in which the temperature of the adhesive in the adhesive container is kept at a fourth temperature lower than the second temperature based on the temperature detected by the temperature sensor following the coating operation, and wherein the control section is configured to control the stirring member to stir for a period of time after the heater has been turned off in the low power mode.

6. The bookbinding apparatus of claim 5, wherein the fourth temperature is the melting point of the adhesive.

7. The bookbinding apparatus of claim 1, wherein said stirring member is a coating roller for the coating operation on a spine of the sheet bundle.

8. The bookbinding apparatus of claim 1, further comprising:

a coating roller for the coating operation on a spine of the sheet bundle.

9. An image forming system comprising:

an image forming apparatus that forms an image on a sheet;

a bookbinding apparatus that coats adhesive on a bundle formed of the sheets conveyed from the image forming apparatus, said bookbinding apparatus comprising:

an adhesive container that accommodates melted adhesive;

a heater that heats the adhesive to melt;

a temperature sensor configured to detect a temperature of the adhesive in the adhesive container;

a stirring member that stirs the adhesive in the adhesive container; and a control section configured to perform the following operations:

determine whether a coating of the adhesive is possible or not with reference to a threshold value temperature corresponding to a second temperature lower than a first temperature adequate for coating, based on the temperature detected by the temperature sensor;

set a coating mode in which a temperature of the adhesive in the adhesive container is kept at the first temperature for the coating operation based on the temperature detected by the temperature sensor;

set a shut-off mode in which the heater is turned off irrespective of the temperature detected by the temperature sensor;

turn off the heater with a completion of the coating operation;

continue a stirring operation by the stirring member for a period of time after the heater has been turned off in the shut-off mode; and stop the stirring operation by the stirring member thereafter.

* * * * *